US005169906A

United States Patent [19]

Cray et al.

[11] Patent Number: 5,169,906

[45] Date of Patent: Dec. 8, 1992

[54] FILM-FORMING COPOLYMERS AND THEIR USE IN WATER VAPOR PERMEABLE COATINGS

[75] Inventors: Stephen E. Cray, South Glamorgan; Martin Rowlands, West Glamorgan, both of Wales

[73] Assignee: Dow Corning Limited, Barry, Wales

[21] Appl. No.: 672,993

[22] Filed: Mar. 21, 1991

[30] Foreign Application Priority Data

Apr. 26, 1990 [GB] United Kingdom ..... 9009409

[51] Int. Cl.[5] ..... C08F 283/00

[52] U.S. Cl. ..... 525/453; 525/474

[58] Field of Search ..... 525/453, 474

[56] References Cited

U.S. PATENT DOCUMENTS 4,011,189 3/1977 Keil ..... 524/731
4,686,137 8/1987 Ward ..... 428/290
4,774,310 9/1988 Butler ..... 528/23

FOREIGN PATENT DOCUMENTS 251435 6/1986 European Pat. Off. .
2087909 11/1980 United Kingdom .

*Primary Examiner*—Melvyn I. Marquis
*Assistant Examiner*—D. E. Aylward
*Attorney, Agent, or Firm*—George A. Grindahl

[57] ABSTRACT

A film-forming copolymer is formed by copolymerising 100 parts of a curable polyurethane resin and 10 to 100 parts of an organosilicon compound, consisting essentially of $SiO_2$, $R_3SiO_{\frac{1}{2}}$ and $R'R_2SiO_{\frac{1}{2}}$ units, the ratio of monovalent units to tetravalent units being from 0.4/1 to 2/1 and from 40 to 90% of and monovalent units being $R'R_2SiO_{\frac{1}{2}}$ units. R is a monovalent hydrocarbon group having up to 8 carbons and R' denotes a OH-terminated polyoxyalkylene group. The invention also includes a method of making fabrics waterproof and permeable to water vapor by coating it with such copolymer.

10 Claims, No Drawings

FILM-FORMING COPOLYMERS AND THEIR USE IN WATER VAPOR PERMEABLE COATINGS

This invention relates to film-forming copolymers and to their use in water vapour permeable coatings, and more particularly polyurethane coatings which are permeable to water vapour while retaining a high degree of impermeability to liquid water. The invention is especially concerned with coatings which are useful for textile materials, for example those which are useful for the production of the so-called breathable waterproof textiles. The invention also relates to such coated textile materials and the products made therefrom.

There has always been a demand for waterproof fabrics, especially for fabrics which at the same time are water-proof and allow water vapour to pass through it. This allows the use of such fabrics for garments and tent material where it improves the level of comfort of the wearer, or user, if water which originates e.g. from perspiration is allowed to evaporate.

Several methods have been proposed to obtain such fabrics. These include the use of tightly woven specialty yarns or yarns made by combining a bulky yarn with a high shrinkage yarn. Another method involves the use of microporous coatings where materials such as polyurethanes or polyvinylchloride contain micropores of an average diameter below 100$\mu$, preferably less than 10$\mu$. These pores do not allow liquid water to pass through but are large enough to allow water vapour molecules to pass through. The use of microporous materials is often combined with the use of a water repellent finish, e.g. based on a silicone polymer. This method is also sometimes combined with the use of a so-called buffer coating which consists of a hydrophilic finish which absorbs excessive water vapour created and stores it close to the microporous layer to allow its transmission at a later stage. A third method of providing breathable waterproof finishes is the use of non-porous hydrophilic coatings. The basic principle behind this is the incorporation of hydrophilic chemical groups into a chain of polymers used for the coating. These hydrophilic groups act as stepping stones allowing the water vapour molecules to pass along the chain and through the coating. The coating accordingly consists of hard, relatively hydrophobic, e.g. polyurethane segments, and soft, relatively hydrophilic, e.g. polyether segments.

In G.B. application 2 087 909 there is provided a breathable non-porous polyurethane film being a block copolymer of a low molecular weight difunctional compound to provide hard segments in the film, a polyethylene glycol to provide soft segments in the film and a diisocyanate, the polyethylene glycol being present in the amount of from 25 to 45% by weight based on the total weight of the film forming constituents. In U.S. patent Specification No. 4,686,137 coated textiles are provided which are impermeable to liquid water but which have high moisture vapour permeability, comprising a fabric web and a uniform non-porous coating on at least one surface of the web, the coating comprising a segmented block multipolymer comprising an essentially linear segmented copolymer chain characterised by at least one polyurethane or polyurethane urea hard segment and a soft block copolymer comprising at least one hydrophilic soft block and one hydrophobic soft block. The hydrophilic component of the soft block may be a polyalkylene oxide and the like. The hydrophobic block may be a polydialkylsiloxane. In J.P. 63/179916 there is provided a thermoplastic polyurethane resin having soft segments of polyols and hard segments of aliphatic diisocyanates and aliphatic diamines. The diols comprise polysiloxane diols and polyoxytetramethylene glycol with a MW of from 800 to 2200.

It has been shown, however, that water vapour permeable waterproof polyurethane coatings for fabrics suffer from poor abrasion resistance and a reduction in water-proofing ability, measured as hydrostatic head when the breathability or water vapour transmissibility is increased. Furthermore, it has been discovered that no commercially available breathable waterproof coatings exist for the textile market which are based on aqueous curable, solid, non-porous polyurethane resins. We have now found that an improved polyurethane coating can be provided by incorporating some organosilicon resins into polyurethane coatings, including some aqueous based polyurethane coatings.

U.S. Specification Pat. No. 4,011,189 discloses the use of certain organosilicon compounds having $SiO_2$ units, $(CH_3)_3SiO_{\frac{1}{2}}$ units and $D(CH_3)_2SiO_{\frac{1}{2}}$ units, wherein D denotes e.g. a polyoxyalkylene copolymer in order to enable dispersion of incompatible lubricating compounds in a polyurethane resin. However, the compositions described are not of the type of breathable coatings for fabric materials with which this invention is concerned. They relate to a method of making microporous materials in which a lubricating agent is used to improve the slipperiness of the coating.

According to one aspect of the present invention there is provided a film-forming copolymer formed by the copolymerisation of 100 parts by weight of a curable polyurethane resin and 10 to 100 parts by weight of an organosilicon compound consisting essentially of tetravalent $SiO_2$ units and monovalent $R_3SiO_{\frac{1}{2}}$ and $R'R_2SiO_{\frac{1}{2}}$ units, the ratio of monovalent units to tetravalent units being from 0.4/1 to 2/1 and from 40 to 90% of all monovalent units present in the organosilicon compound being $R'R_2SiO_{\frac{1}{2}}$ units, wherein R denotes a monovalent hydrocarbon group having up to 8 carbon atoms and R, denotes a polyoxyalkylene group which is terminated by a hydroxyl group.

The curable polyurethane resin provides the hard segments of the copolymer. Useful curable polyurethane resins include both solvent based and water based resins and are exemplified by polyether urethanes, polyester urethanes and polyether urethane ureas. The term curable polyurethane resins as defined herein excludes the so-called one component or coagulated polyurethane which is used in the formation of microporous urethane coatings. Such coagulating materials are usually dissolved in e.g. dimethyl formamide. When coated onto a textile basis and submerged in water they cause the urethane to precipitate and coagulate, thus forming a microporous sponge as the dimethylformamide dissolves into the water phase. Also excluded are the so-called air drying polyurethane systems which are prereacted to such extent that virtually no reactivity is left on the molecules.

Useful curable polyurethane resins are the so-called two component polyurethane compositions. These compositions provide difunctional molecules which are at most partially reacted with a crosslinker, leaving some unused reactivity which allows the composition to cure fully in the right conditions. Preferably low molecular weight difunctional compounds are used including straight or branched chain aliphatic compounds, cyclic compounds and aromatic compounds in which the functional groups are of substantially equal reactivity. Examples of low molecular weight difunctional compounds which can be used include diols such as ethylene glycol, diethylene glycol, triethylene glycol, 1,4-butanediol, thiodiglycol, 2,2,-dimethylpropane-1,3-diol, 1,4-bishydroxymethyl-benzene, bishydroxyethyl disulphide, cyclohexane-dimethanol, diamines such as ethylene diamine, dihydrazides such as carbodihydrazide, oxalic hydrazide, hydrazine and substituted hydrazines. By increasing the molecular weight of the difunctional unit the hardness of the segments is reduced. It is therefore preferred not to use difunctional compounds for the hard segment which have a molecular weight in excess of 200. A single difunctional compound may be used as well as a mixture of two or more such compounds.

Crosslinkers may be isocyanate or formaldehyde compounds. Examples of suitable crosslinkers are diphenylmethane-4,4-diisocyanate, toluene diisocyanate, hexamethylene-1,6-diisocyanate, 1-isocyanato-3,3,5-trimethyl-5-isocyanatomethyl cyclohexane and melamine formaldehyde. Suitable polyurethane compositions cure by reaction of e.g. polymeric ether glycols and a diisocyanate crosslinker, optionally also including chain extension with diamine or dihydroxy derivatives. By the use of various types of crosslinkers, e.g. aliphatic or aromatic isocyanates, various types of glycols, e.g. polyoxyethylene, polyoxypropylene or polyoxytetramethylene and various types of chain extenders, the structural properties of the polyurethane segment of the copolymer may be varied depending on the end use of the material. Particularly preferred is a polyurethane urea formed from the polymerisation of diphenylmethane diisocyanate, ethylene diamine and polytetramethylene oxide. Curable compositions may also include catalysts which accelerate the curing of the components. Suitable catalysts include organic acids, e.g. p-toluene sulphonic acid. It is preferred that the curable polyurethane resin is provided as a solution or dispersion in a suitable solvent or medium. Preferred solvents include dimethyl formamide, toluene and ethyl acetate. It is preferred to have a solids content in the range from 35 to 50% by weight.

Organosilicon compounds which are useful in the formation of the copolymers of the present invention are materials which have monovalent siloxane units of the general formulae $R_3SiO_{\frac{1}{2}}$ and $R'R_2SiO_{\frac{1}{2}}$ and tetravalent units of the formula $SiO_{4/2}$. A minor amount of trivalent or divalent units could also be present but they should not exceed 5% of all siloxane units present in the organosilicon compound. The ratio of monovalent units to tetravalent units is from 0.4/1 to 2/1. Suitable organosilicon compounds may be liquid or solid at ambient temperature, e.g. 20° C. R denotes a monovalent hydrocarbon group having up to 8 carbon atoms. It may be an alkyl, aryl, alkenyl, alkynyl, alkaryl or aralkyl group. Examples of such groups include methyl, ethyl, propyl, hexyl, phenyl, vinyl, allyl, hexenyl, propargyl, tolyl, phenylethyl and styryl groups. It is preferred that at least 80% of all R groups in the organosilicon compound are lower alkyl or aryl groups, most preferably methyl groups. It is even more preferred that substantially all R groups are methyl groups.

The group R' denotes a polyoxyalkylene group which is terminated by a hydroxyl group. In order to improve compatibility and breathability of the copolymer when formed into a coating it is preferred that at least 50% of all oxyalkylene groups in the polyoxyalkylene group are oxyethylene groups. Any other oxyalkylene groups present are preferably oxypropylene or oxytetramethylene groups. It is most preferred that at least 80% of all the oxyalkylene groups are oxyethylene groups. It is also preferred that the polyoxyalkylene groups are attached to a silicon atom via —SiC— bonds as such bonds are believed to be more hydrolitically stable than —SiOC— bonds. The terminal hydroxyl group gives the polyoxyalkylene groups a reactivity which allows it to be bonded into the polyurethane resin described above. The polyoxyalkylene groups preferably have a molecular weight which is at least 300, more preferably at least 500. The higher the molecular weight, especially in the case of the oxyalkylene units being mainly oxyethylene units, the better the water vapour permeability will be of a coating formed by the copolymer. However, too high a molecular weight will tend to reduce the strength and the waterproofing of the coating. It is therefore preferred that the polyoxyalkylene has a molecular weight which does not exceed 1000. It is also preferred to have a higher molecular weight of the oxyalkylene group if the polyurethane resin is aqueous, as this improves the compatibility of the organosilicon compound with the polyurethane resin.

In order for the organosilicon compounds to be suitable in the formation of the copolymers of the present invention from 40 to 90% of all monovalent units present must have the formula $R'R_2SiO_{\frac{1}{2}}$. This is important in order to achieve the required level of water vapour permeability. Levels below 40% will result in a copolymer which is water-proof but not sufficiently breathable, while levels above 90% will negatively affect the waterproofing and abrasion resistance of the copolymer. The formation of organosilicon compounds with more than 90% of the monovalent units having the formula $R'R_2SiO_{\frac{1}{2}}$ will also be difficult because of gelling. Organosilicon compounds which may be used in the present invention preferably have a ratio of monovalent to tetravalent siloxane units which is above 1/1, more preferably from 1.3/1 to 1.8/1 and most preferably from 1.4/1 to 1.6/1. Organosilicon compounds which have the preferred ratio of monovalent over tetravalent siloxane units tend to be liquid at ambient temperatures and can therefore easily be mixed in with the polyurethane resin. It is preferred that the organosilicon compounds are those which are still liquid, but have a molecular weight which is not too low, in order to avoid a copolymer which is overly densely crosslinked as this would negatively effect the flexibility of any coating made by the copolymer and may also reduce the permeability to water vapour. Solid organosilicon compounds can, however, also be used but would be provided as a solution or dispersion in a suitable solvent or other medium.

Organosilicon compounds can be made according to known methods. The preferred method includes the reaction of organosilicon compounds consisting essentially of tetravalent $SiO_2$ units and monovalent units of the general formulae $R_3SiO_{\frac{1}{2}}$ and $HR_2SiO_{\frac{1}{2}}$ in the required ratios with alkenyl endblocked polyoxyalkylene compounds, e.g. vinyl or allyl endblocked polyoxyethylene polymers or vinyl or allyl endblocked polyoxyethylene-polyoxypropylene copolymers. SiH containing organosilicon compounds which can be used in the preparation of suitable organosilicon compounds are known compounds and have been described, together with their preparation method, in E.P. specification 251 435.

The copolymer is made by the reaction of the polyurethane resin and the organosilicon compounds. This can be done according to standard methods. In view of the presence of reactive groups, a composition can be prepared by merely mixing the two components which may then be cured e.g. at elevated temperatures in order to form the copolymer. It is, however, preferred that the organosilicon compound is first dissolved in a suitable solvent, e.g. ethyl acetate, toluene or water. Compositions which contain such mixtures of the polyurethane resin and the organosilicon compound may be prepared by adding the components in whichever order is most convenient. The composition should comprise from 10 to 100 parts by weight of the organosilicon compound per 100 parts by weight of the polyurethane resin. Preferably 15 to 70 parts of the organosilicon compound are used for every 100 parts by weight of the polyurethane resin, most preferably 17 to 50. It is preferred that the amount of crosslinker used in the polyurethane resin is increased over the amounts provided in commercially available polyurethane resins for those copolymers where a relatively higher amount of oxyalkylene functionality is provided by the organosilicon compound. Catalyst levels may also be increased accordingly in order to retain reasonably short crosslinking times. Suitable compositions may also comprise solvents, diluents, pigments, catalysts, fillers, dyes and other materials which are well known and standard ingredients for textile coating compositions.

If the copolymer is used for the formation of a waterproof coating which is capable of allowing water vapour to permeate through it, on a textile fabric or other substrate, the composition which comprises the mixture of the polyurethane resin and the organosilicon compound may be applied to said fabric or substrate as a film of the appropriate thickness, and the coated fabric or substrate may be submitted to conditions in which the copolymer will be formed and cured. The composition may be applied by any of the standard methods. These include padding, spraying, direct coating, transfer coating, melt calendering and laminating of preformed films.

In a further aspect the invention provides a method of treating substrates, particularly textile fabrics, with a waterproof coating which allows water vapour to permeate through said coating, which comprises applying to the substrate or textile fabric a composition comprising 100 parts by weight of a curable polyurethane resin and from 25 to 100 parts by weight of an organosilicon compound consisting essentially of tetravalent $SiO_2$ units and monovalent $R_3SiO_{\frac{1}{2}}$ and $R'R_2SiO_{\frac{1}{2}}$ units, the ratio of monovalent units to tetravalent units being from 0.4/1 to 2/1 and from 40 to 90% of all monovalent units present in the organosilicon compound being $R'R_2SiO_{\frac{1}{2}}$ units, wherein R denotes a monovalent hydrocarbon group having up to 8 carbon atoms and R' denotes a polyoxyalkylene group which is terminated by a hydroxyl group and curing said composition to a film which adheres to the substrate or textile fabric.

In yet another aspect the invention provides a method of treating substrates, particularly textile fabrics, with a waterproof coating which allows water vapour to permeate through said coating, which comprises forming a self supporting copolymer film from a composition comprising 100 parts by weight of a curable polyurethane resin and from 10 to 100 parts by weight of an organosilicon compound consisting essentially of tetravalent $SiO_2$ units and monovalent $R_3SiO_{\frac{1}{2}}$ and $R'R_2SiO_{\frac{1}{2}}$ units, the ratio of monovalent units to tetravalent units . from 0.4/1 to 2/1 and from 40 to 90% of all monovalent units present in the organosilicon compound being $R'R_2SiO_{\frac{1}{2}}$ units, wherein R denotes a monovalent hydrocarbon group having up to 8 carbon atoms and R' denotes a polyoxyalkylene group which is terminated by a hydroxyl group and laminating said preformed film onto the substrate or textile fabric.

The invention also provides substrates or textile fabrics which are coated with a copolymer as described above.

Fabric materials which have been coated according to the method of the invention have improved waterproofing characteristics and provide a breathable material, which at the same time retains a flexibility and abrasion resistance which is required for such fabrics. They are particularly useful in the making of waterproof garments, tenting materials, tarpaulins and similar materials.

The invention will now be illustrated in some examples in which all parts and percentages are expressed by weight, unless otherwise stated.

Preparation of suitable orqanosilicon compounds

In a flask equipped with a dropping funnel, condenser, thermometer and stirrer, y moles of $CH_2{=}CH{-}CH_3(OCH_2CH_2)_{12}OH$ were charged together with 25 ml of a 5% solution of chloroplatinic acid in isopropanol, 200 ml of toluene and 0.5 g of sodium acetate. The dropping funnel was charged with 200 g of an organosilicon resin of the general formula $[(CH_3)_3SiO_{\frac{1}{2}}]_x[(CH_3)_2HSiO_{\frac{1}{2}}]_y[SiO_2]_z$ which was added to the mixture under agitation as soon as this had reached a temperature of 90° C. Upon completion of the addition the mixture was heated to reflux temperature and maintained there till all SiH groups had reacted (this was monitored by infrared spectroscopy). The resulting organosilicon compound was analysed and found to have the general formula $$[(CH_3)_3SiO_{\frac{1}{2}}]_x[(CH_3)_2SiO_{\frac{1}{2}}]_y[SiO_2]_z(CH_2)_3(OCH_2CH_2)_{12}OH$$

wherein the ratio x/y/z has the value given in Table I for Compounds MQ1 to MQ6. All compounds were liquid materials and the viscosity is also given in Table I.

TABLE I

| | Ratio of x/y/z | Viscosity ($mm^2/s$) |
|---|---|---|
| MQ1 | 1.4/0.4/1.0 | 650 |
| MQ2 | 1.0/0.6/1.0 | 830 |
| MQ3 | 0.7/0.8/1.0 | 1020 |
| MQ4 | 0.6/1.0/1.0 | 630 |
| MQ5 | 0.4/1.2/1.0 | 770 |
| MQ6 | 0.2/1.4/1.0 | 810 |

The same method was used for making MQ7 which has the x/y/z ratio of MQ3, but oxyalkylene units of the formula $-(CH_2)_3(OCH_2CH_2)_{32}OH$.

EXAMPLES 1 TO 6

100 parts of a polyurethane composition, Larithane® B850 provided by Larim SpA, which is a 50% dispersion of an aromatic polyester, two-component polyurethane in ethyl acetate, 5 parts of Larithane®

CL2 which is a 50% solution of melamine formaldehyde resin crosslinker in a $C_4$ alcohol, 0.5 part of Larithane® CL2 which is a 25% solution of p-toluene sulphonic acid catalyst in a $C_4$ alcohol, 3 parts of a matting agent and 20 parts of a 50% solution of MQ1 through MQ6 respectively, for Examples 1 to 6 in ethyl acetate were mixed till homogeneous.

A Wiggins Teape® 703 plain transfer coating paper was coated with each of the compositions of Examples 1 to 6 by coating a first layer which was dried for 30 seconds at 90° C., heated for 15 seconds at 150° C., coating a second layer, drying for 15 seconds at 90° C. and curing at 150° C. for 2 minutes. The film thickness of the combined coats gave a coating density of 30g/m$^2$. The coated film was then peeled from the backing paper to give Films 1 to 6 and were subjected to breathability test. The compositions of Examples 1 to 6 were also coated onto 4 oz nylon fabric according to the same coating method to give Fabrics 1 to 6 which were subjected to a different test.

EXAMPLES 7 to 9

Three compositions were prepared by mixing 100 parts of Larithane® B850 with MQ3, Larithane® CL2, Larithane® CT2 and ethyl acetate in parts as given in Table II. The compositions were then coated onto Wiggins Teape® 703 paper and 2 oz nylon by the method described for Examples 1 to 6, giving Films 6 to 9 and Fabrics 6 to 9.

TABLE II

| Example | MQ3 | CL2 | CT2 | Ethyl Acetate |
|---|---|---|---|---|
| 7 | 10 | 6 | 1.2 | 15 |
| 8 | 16.7 | 10 | 2.0 | 20 |
| 9 | 28 | 17 | 3.4 | 25 |

EXAMPLES 10 to 13

Four compositions were prepared by mixing 100 parts of Larithane® B835, which is a 35% dispersion of a high molecular weight aromatic polyester, two-component polyurethane in ethyl acetate with MQ3, Larithane® CL2, Larithane® CT2 and ethyl acetate in parts as given in Table III. The compositions were then coated onto Wiggins Teape® 703 paper and 2 oz nylon by the method described for Examples 1 to 6, giving Films 10 to 13 and Fabrics 10 to 13.

TABLE III

| Example | MQ3 | CL2 | CT2 | Ethyl Acetate |
|---|---|---|---|---|
| 10 | 4 | 5 | 1.0 | 10 |
| 11 | 8.8 | 5 | 1.0 | 15 |
| 12 | 15.3 | 9.3 | 1.9 | 20 |
| 13 | 23.5 | 14 | 2.8 | 25 |

EXAMPLE 14

A composition was prepared by mixing 100 parts of L9012, which is a 30% aqueous polyurethan resin, based on branched aromatic polyeters, and was supplied by BIP Chemicals Ltd, with 15 parts of MQ7, 3 parts of a melamine formaldehyde crosslinker, 4 parts of a thickener and 0.3 parts of a sulphonic acid catalyst. The composition was then coated onto 2 oz nylon by the method described for Examples 1 to 6, giving Fabric 14.

COMPARATIVE EXAMPLES C1 to C7

C1 was a composition as given for Examples 1-6 wherein the organosilicon compound MQ was left out;

C2 was a composition as given for Example 7 except that no MQ3 was used, only 5 parts of CL2, only 0.5 parts of CT2 and only 10 parts of ethyl acetate were used;

C3 was a composition as given for Example 7 except that only 5 parts of MQ3, 5 parts of CL2, 1 part of CT2 and 10 parts of ethyl acetate were used;

C4 was a composition as given for Example 10 except that no MQ3 was used and only 0.5 parts of CT2 was used;

C5 was a commercially available fabric of a 3-layer laminate with a microporous PTFE film, from W. L. Gore and Associates;

C6 was a microporous polyurethane film from Porvair called Porelle®;

C7 was a hydrophilic film according to J.P. application 63/179916.

Examples C1 to C4 were made into Films C1 to C4 and Fabrics C1 to C4 according to the method explained in Examples 1 to 6.

TESTS

Breathability was tested by filling aluminium cups with a surface area of 54 cm$^2$ with 42 g of water and fixing the Fabric or Film over the cup with an adhesive. A plate of Locatex® PE18 fabric which is 100% breathable, was placed over this and the cups were allowed to reach equilibration by placing them on a vibration-free rotating table in an atmosphere of 65% relative humidity (RH) at 20° C. The cups were then weighed accurately and replaced on the rotating table for 24 hours, after which they were weighed again. Two calibration cups only covered with a plate of Locatex® PEI8 are also weighed and the breathability is calculated as 100×the ratio of the weight loss of the cup with the tested film or fabric over the weight loss of the calibration cup (average of 2).

Abrasion resistance was measured by using a Martindale® abrasion tester with a 9KPa load to complete breakdown of the polyurethane coating on fabrics only.

Hydrostatic head was measured on a Shirley® Hydrostatic Head Tester as the height of water column (in cm) required to cause 3 drops of water to penetrate the fabric up to a maximum of 150 cm. This test was carried out on coated fabric both when first coated and after the fabric pieces had been subjected to 5 wash cycles at 40° C. with 50 g of detergent per cycle according to ISO standard 6330-6A.

TEST RESULTS

TABLE IV

| | Breathability (%) | | Hydrostatic Head (cm) | |
|---|---|---|---|---|
| Example | Film | Fabric | Initial | After washes |
| 1 | 69 | 31 | 150 | 73 |
| 2 | 71 | 36 | 150 | 88 |
| 3 | 82 | 36 | 150 | 82 |
| 4 | 82 | 38 | 150 | 76 |
| 5 | 80 | 39 | 150 | 116 |
| 6 | 80 | 40 | 150 | 79 |
| 7 | 82 | 40 | 150 | — |
| 8 | — | 46 | 150 | — |
| 9 | — | — | 150 | — |
| 10 | 63 | 63 | 150 | 53 |
| 11 | 70 | 70 | 150 | 66 |
| 12 | 72 | 72 | 150 | 150 |

TABLE IV-continued

| Example | Breathability (%) | | Hydrostatic Head (cm) | |
|---|---|---|---|---|
| | Film | Fabric | Initial | After washes |
| 14 | — | 75 | 150 | 80 |
| C1 | 52 | 21 | 150 | 70 |
| C2 | 52 | 30 | 150 | — |
| C3 | 67 | — | — | — |
| C4 | 49 | 32 | 150 | 29 |
| C5 | — | 83 | — | — |
| C6 | 73 | — | — | — |
| C7 | 78 | — | — | — |

The results show that breathability of films made according to the invention is very satisfactory. It approaches commercially available systems which use expensive technology (Gore-TEX ®). Breathability on fabrics was lower than for the film partially because the direct coating method tended to push the coating into the pores of the fabric, thus increasing the thickness of the coating in those places. A method of transfer coating should improve the results. Abrasion resistance was acceptable in all cases (Fabric 1 to Fabric 14).

That which is claimed is:

1. A copolymer formed by the copolymerisation of 100 parts by weight of a curable polyurethane resin and 10 to 100 parts by weight of an organosilicon compound, consisting essentially of tetravalent $SiO_2$ units and monovalent $R_3SiO_{\frac{1}{2}}$ and $R'R_2SiO_{\frac{1}{2}}$ units, wherein the ratio of monovalent units to tetravalent units is from 0.4/1 to 2/1 and from 40 to 90% of all monovalent units present in the organosilicon compound are $R'R_2SiO_{\frac{1}{2}}$ units wherein R denotes a monovalent hydrocarbon group having up to 8 carbon atoms and R′ denotes a polyoxyalkylene group which is terminated by a hydroxyl group.

2. A copolymer according to claim 1 wherein the polyurethane resin is an aqueous two component polyurethane resin composition having a solids content in the range from 35 to 50% by weight.

3. A copolymer according to claim 1 wherein the polyurethane resin is a solvent based two component polyurethane resin composition having a solids content in the range from 35 to 50% by weight.

4. A copolymer according to claim 1 wherein at least 80% of all R groups in the organosilicon compound are selected from the group consisting of lower alkyl and aryl groups.

5. A copolymer according to claim 1 wherein in the group R′ at least 80% of all the oxyalkylene groups are oxyethylene groups, all polyoxyalkylene groups being attached to a silicon atom via —SiC— bonds.

6. A copolymer according to claim 1 wherein the polyoxyalkylene groups have a molecular weight of from 300 to 1000.

7. A copolymer according to claim 1 wherein the ratio of monovalent to tetravalent siloxane units in the organosilicon compound is from 1.3/1 to 1.8/1.

8. A copolymer according to claim 1 wherein the ratio of monovalent to tetravalent siloxane units in the organosilicon compound is from 1.4/1 to 1.6/1.

9. A copolymer according to claim 1 wherein 15 to 70 parts of the organosilicon compound are used for every 100 parts by weight of the polyurethane resin.

10. A copolymer according to claim 1 wherein 17 to 50 parts of the organosilicon compound are used for every 100 parts by weight of the polyurethane resin.

* * * * *